US006752045B2

(12) United States Patent
Badiali

(10) Patent No.: US 6,752,045 B2
(45) Date of Patent: Jun. 22, 2004

(54) ADJUSTABLE WRENCH

(75) Inventor: John A. Badiali, Nokomis, FL (US)

(73) Assignee: Custom Spec Engineering, Inc., Nokomis, FL (US)

( * ) Notice: Subject to any disclaimer, the term of this patent is extended or adjusted under 35 U.S.C. 154(b) by 133 days.

(21) Appl. No.: 10/222,395

(22) Filed: Aug. 16, 2002

(65) Prior Publication Data

US 2004/0031358 A1 Feb. 19, 2004

(51) Int. Cl.[7] ..... B25B 13/46
(52) U.S. Cl. ..... 81/57.39; 81/63
(58) Field of Search ..... 81/57.39, 63, 58.1

(56) References Cited

U.S. PATENT DOCUMENTS 3,286,560 A * 11/1966 Murray ..... 81/58.1
3,726,161 A 4/1973 Williams et al.
3,941,017 A * 3/1976 Lenker et al. ..... 81/57.39
4,031,785 A * 6/1977 Wheeler ..... 81/57.39
4,339,969 A * 7/1982 Hage ..... 81/57.39
5,309,796 A * 5/1994 Jones ..... 81/57.39

* cited by examiner

*Primary Examiner*—James G. Smith
(74) *Attorney, Agent, or Firm*—Gifford, Krass, Groh, Sprinkle, Anderson & Citkowski, P.C.

(57) ABSTRACT

A squeeze type, rotating wrench has a toothed drive gear for receiving selected tool elements. The drive gear is driven in a selected direction by a push arm and reversible pawl upon squeezing of a pair of handles relative to each other. Reversing the direction of rotation is accomplished by pivoting the pawl from one position to another relative to the push arm.

19 Claims, 4 Drawing Sheets

ADJUSTABLE WRENCH

FIELD OF THE INVENTION

This invention relates to ratchet wrenches and more particularly to squeeze type ratchet wrenches that have a reversible drive direction.

BACKGROUND OF THE INVENTION

With a typical ratchet wrench, a socket is formed at one end of a body member having a handle at the other end with the socket receiving a bolt head or nut or other tool. Swinging of the handle in one direction rotates the socket in a corresponding arc to move the work piece and in the other direction permits return of the handle. However, swinging of the handle is not always possible when working in confined areas. As a consequence, provision has been made for squeeze type ratchet wrenches in which a pair of handles are squeezed toward each other as in the case of pliers to achieve rotation of a socket with the body of the tool remaining substantially stationary. Such wrenches can reverse the direction of drive by turning the tool on its longitudinal axis to reverse the axis of rotation of the socket 180°. Subsequent squeezing rotates the socket in the opposite direction from its prior position.

Even such wrenches are not satisfactory in certain confined areas where handles of the wrench may not permit reversing of the socket. There is a need for a reversible ratchet wrench in which the direction of drive can be reversed without removing the tool from its position relative to the work piece which is being gripped by the socket.

SUMMARY OF THE INVENTION

It is an object of the invention to provide a ratchet wrench in which the drive socket can be driven in either direction without moving its supporting handle in an arc.

It is another object of the invention to provide a ratchet wrench in which the direction of drive can be changed without rotating the tool body to turn the axis of the drive socket 180°.

Still another object of the invention is to provide a ratchet wrench which is selectively reversible without removing the tool from the work piece.

Still a further object of the invention is to provide a ratchet wrench which has a simple construction and in which a single spring accomplishes multiple functions of returning a handle to its original position, loading a spring detent and acting as an over center spring to maintain a pawl in engagement with a single drive gear.

The objects and purpose of the invention are obtained by a squeeze type wrench having an elongated body member, with a handle at one end and a tooth drive gear at the other end for receiving a tool element detachably connected to the drive gear for rotation therewith. A finger grip member is pivoted to the body member which, when squeezed toward the handle, causes movement of a push arm with an elongated pawl member having a pair of sets of teeth for engagement with the tooth drive gear. The pawl arm is guided longitudinally of the body member upon squeezing of the handle and the pawl arm is moveable to one of two positions having a first end or a second end in engagement with the gear to determine the direction of drive. Spring means are provided to resist pivoting of the finger grip member towards the handle and to assist pivoting away from the handle and at the same time providing the resilient force urging a detent into engagement with the gear and to act as an over center spring to maintain one or the other of the two sets of teeth on the pawl arm in engagement with the drive gear.

The ratchet wrench of the present invention can be operated in the conventional manner by moving the handle in an arc and also can be reversed in the direction of drive by turning the tool from one side to the other. In addition the wrench can be operated without moving the handle and its direction of drive can be reversed without being removed from its position on the work piece.

DETAILED DESCRIPTION

Figure 1:
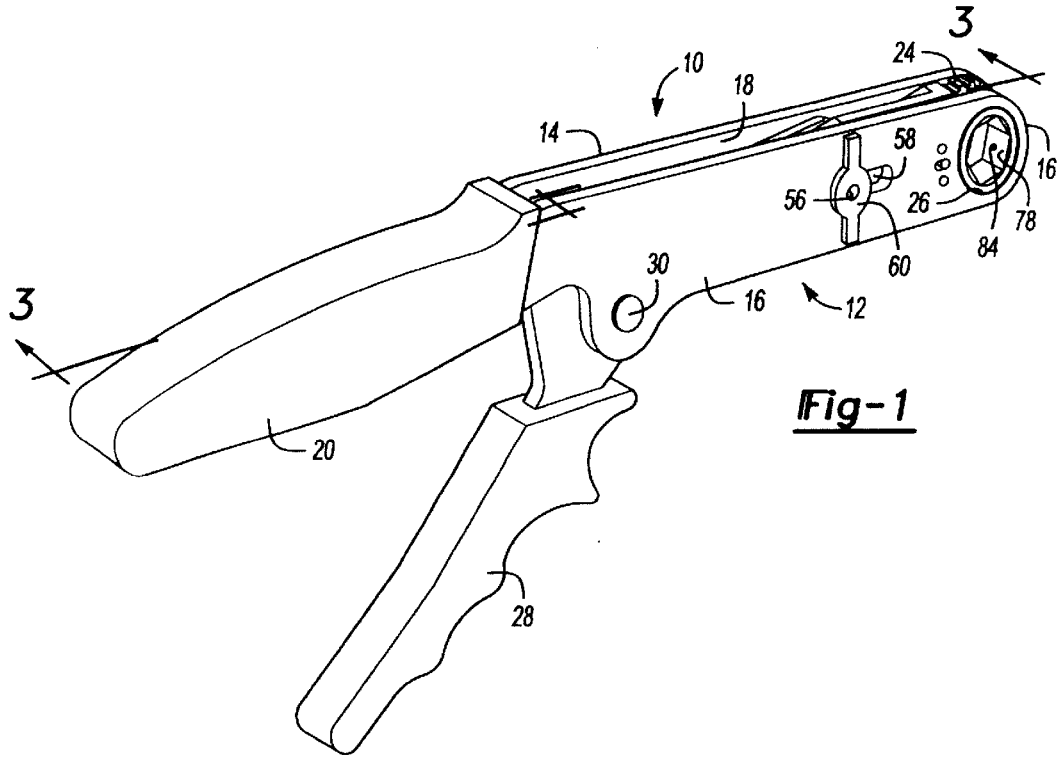
FIG. 1 is a perspective view of the wrench embodying the invention.

The squeeze type, reversible wrench embodying the invention is designated generally at 10 and includes an elongated body member 12 having a pair of substantially identical side frame elements 14 and 16 made of metal and held in spaced apart relationship to form a long recess 18 therebetween. A handle 20 is formed at one end of the body member 12. The opposite end has a rotatable drive gear 24 journaled in aligned openings 26 in frame elements 14 and 16.

The body member 12 also is provided with a squeeze lever 28 having an end portion disposed in recess 18 and pivoted about a rivet 30 seated in aligned openings 32 in frame elements 14 and 16 and squeeze lever 28. Rivet or pin 30 acts as a fulcrum for moving the squeeze lever toward and away from the handle 20.

The handle 20 and gripping portion of the squeeze lever 28 are provided with a resilient material covering the metal portions of the wrench 10 to be gripped by the hand of a user.

Figure 2:
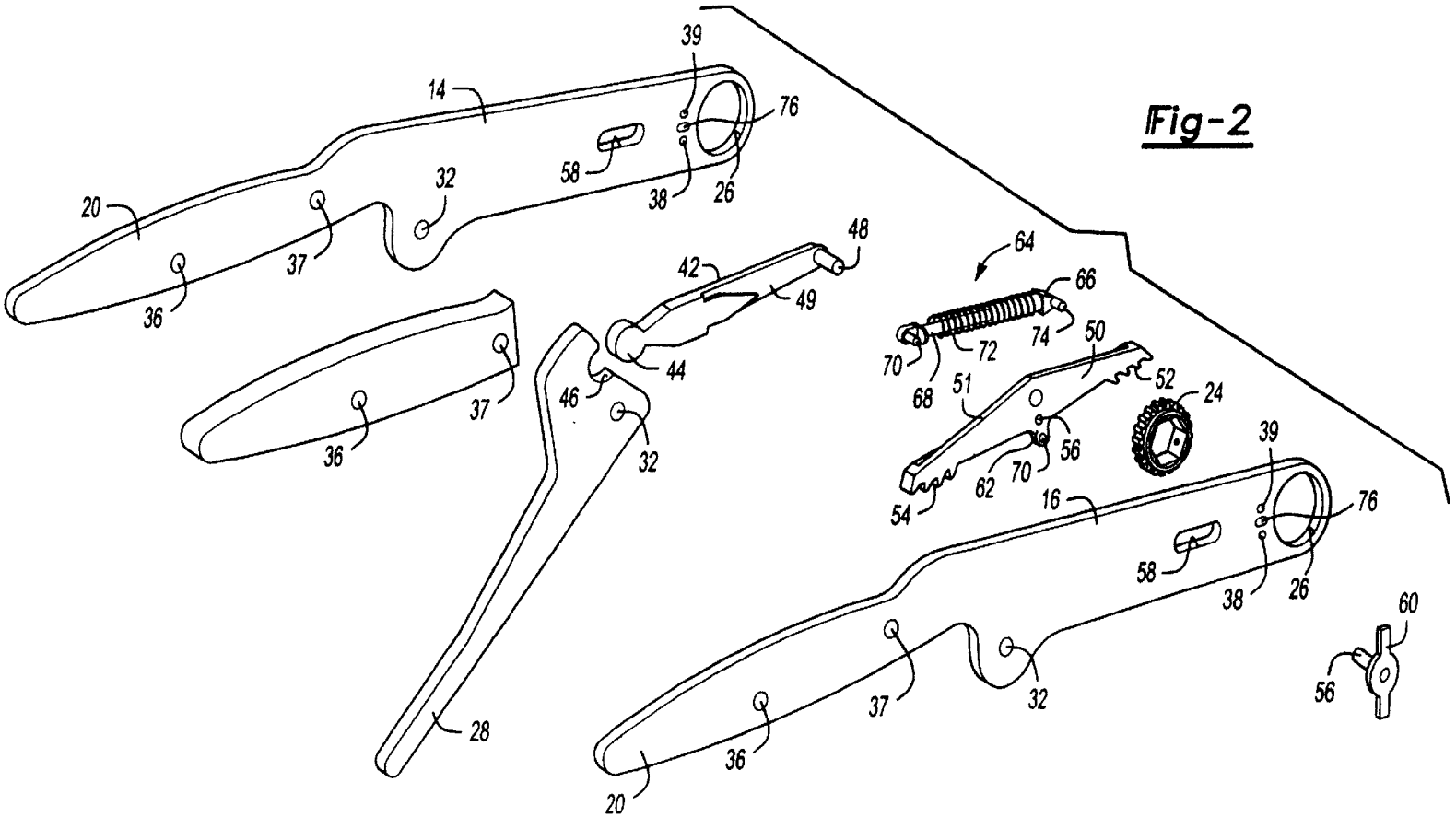
FIG. 2 is an exploded view of the wrench seen in FIG. 1.

As best seen in FIG. 2, the frame elements 14 and 16 are held in spaced apart relationship at the handle end 20 by a frame spacer 34. At the other end frame elements 14 and 16 are held in spaced relationship by the drive gear 24. The side frame elements 14 and 16 are fixed in the spaced relation relative to each other by rivet 30 and rivets passing through aligned openings 36, 37, 38 and 39 as best seen in FIG. 2.

The mechanism for rotating the gear includes a push arm 42 disposed in the recess 18 and has a circular end portion 44 resting in a complementary cavity 46 formed in a portion of the squeeze lever 28 spaced slightly from the rivet at 30 that acts as the fulcrum for the squeeze lever 28. The opposite end of the push arm 42 provided with support pin 48 forming a pivot for a reversing pawl arm 50 that extends in opposite directions from the support pin 48 and is generally symmetrical relative thereto. As seen in FIG. 2, the push arm 42 has a thin portion 49 at the end with support pin 48 that is about one-half the thickness of circular end 44. The pawl arm 50 also has a thin portion 51 opposite to teeth 52 and 54 that overlap push arm 42 so that both arms can fit in the recess 18. A pair of sets of teeth 52 and 54 are formed at opposite ends of the pawl arm 50 and a selected one of the sets 52 or 54 are engagable with the teeth on the opposite circumferential sides of the drive gear 24.

The reversible pawl arm or double ended pawl 50 is provided with a guide pin 56 that is non-rotatably fixed to the arm and is seated in aligned slots 58 in the side frames 14 and 16. The guide pin 56 which is non-rotatably fixed to the double-ended pawl arm 50 also is non-rotatably fixed to a handle 60 at the exterior to one side of the body member 12. The handle 60 is gripped by the fingers for rotating the reversible pawl arm about the pin 48 at the end of the push arm 42.

The double ended or reversible pawl arm 50 also is provided with a crank arm 62 projecting away from the guide pin 56 at the side opposite to the support pin 48. The crank arm 62 acts to support one end of a detent and spring mechanism indicated generally at 64. The mechanism 64 includes a detent element 66 for engagement with the spaces between adjacent teeth on the drive gear 24. Detent 66 is supported at one end of a telescoping member 68 which has its other end pivoted to the crank arm 62 at pivot pin 70. The mechanism and particularly the telescoping member 68, supports a coil spring 72 having opposite ends seated against the crank arm 62 and the detent element 66 to urge the detent into engagement with teeth on the drive gear 24. The detent element 66 is provided with a cross pin 74 guided in aligned slots 76 in the side frames 14 and 16.

Figure 7:
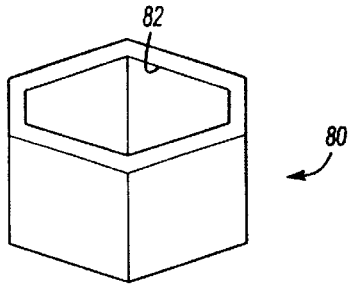
FIG. 7 is a perspective view of a typical insert used with the wrench.

The drive gear 24 is provided with a central opening 78 adapted to receive various socket inserts, only one of which is shown at 80 in FIG. 7. All of such inserts have the same outer hexagon configuration with the inside shape 82 varying in size to accommodate a full range of bolt heads or to accept adaptors for other tools such as screw driver bits, none of which are shown. The socket inserts 80 are releasably held in position within the hexagon opening 78 by a ball detent 84 seen in FIG. 1 in a conventional manner to facilitate interchange of inserts 80.

The wrench 10 is used by selecting the appropriate size or type of insert 80 and inserting it in the opening 74. Thereafter, the direction of rotation of the drive gear 24 and the insert 80 can be selected by rotating the pawl arm 50 to one of its two selected positions as shown in either FIG. 4 or FIG. 6.

Figure 3:
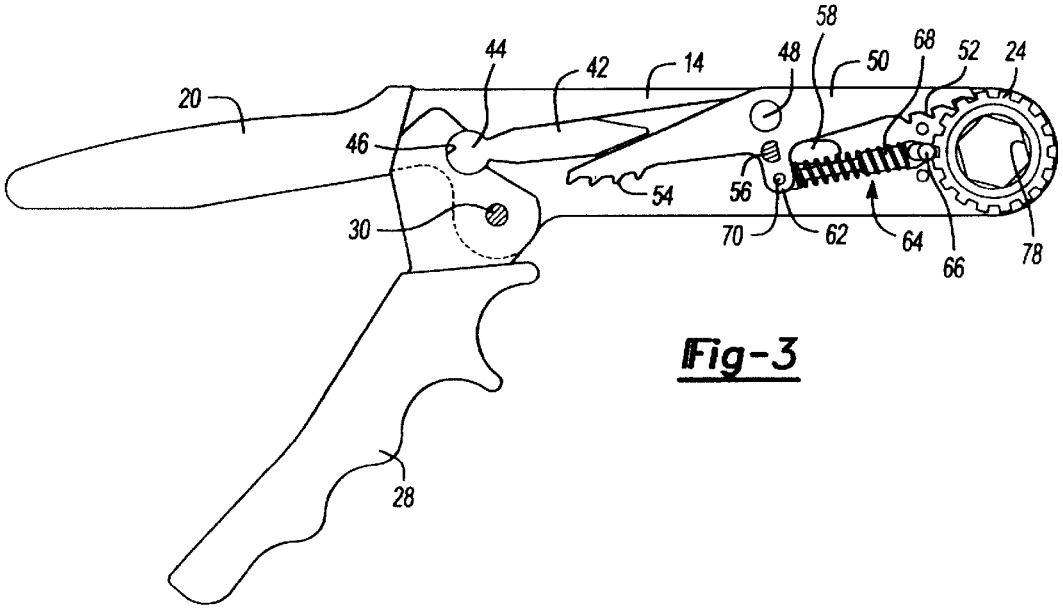
FIG. 3 is a sectional side view taken on a regular section line 3—3 in FIG. 1.
Figure 4:
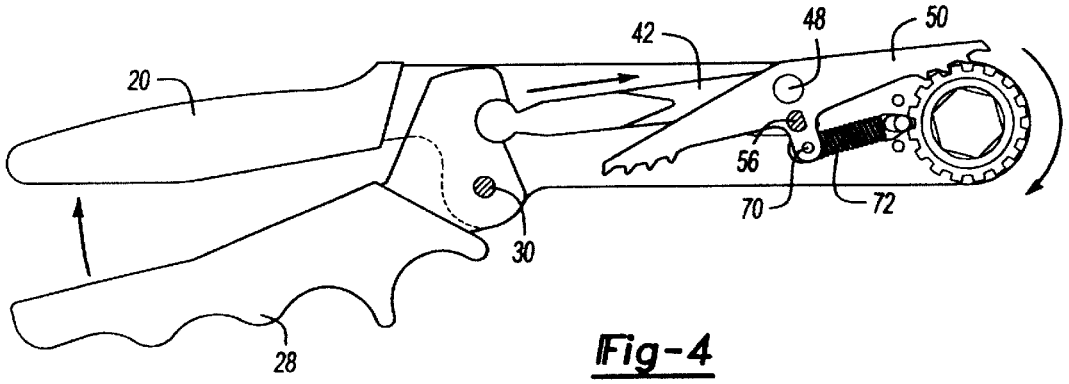
FIG. 4 is a view similar to FIG. 3 showing another condition of operation of the wrench embodying the invention.

With the tool insert 80 and the direction of rotation of the drive gear 24 selected, the wrench 10 is used by squeezing the lever 28 towards the lever 20 from the positions seen in FIG. 3 and FIG. 4. This motion is transferred through the circular end 44 on the push arm 42 and the complementary cavity 46 in the squeeze lever 28 which causes the push arm 42 to move longitudinally within the recess 18 in the body member 12. Such motion is transmitted through support pin 48 to reversing pawl arm 50. The pawl arm 50 is guided by guide pins 56 sliding longitudinally of the body member in slots 58.

During such movement, the set of teeth 52 are pressed into engagement with a circumferential side of drive gear 24 by the action of spring 72 acting on guide pin 56 sliding in guide slots 58 to pivot pawl arm 50 about pin 48. Such movement causes rotation of the drive gear 24 in a clockwise direction as viewed in FIG. 3 and FIG. 4. This causes the detent elements 66 to move from between the teeth on the drive gear 24 against the action of spring 72 to the next spacing between adjacent gear teeth. In the embodiment illustrated, the gear 24 has sixteen teeth so that a single squeeze of lever 28 is effective to rotate the gear 24 to an arc of two gear teeth. In other words, a full rotation of the gear requires eight complete cycles of operation of squeeze lever 28.

During operation of squeeze lever 28 toward handle 20 and resultant movement of push arm 42, the reversing pawl arm 50 pivots slightly relative to push arm 42 and spring 72 is compressed as shown in FIG. 4. Upon release of squeeze lever 28, detent element 66 holds the drive gear 24 stationary and spring 72 returns the squeeze lever 28 to its original position together with push arm 42 and reversing pawl arm 50 to the position shown in FIG. 3.

Figure 5:
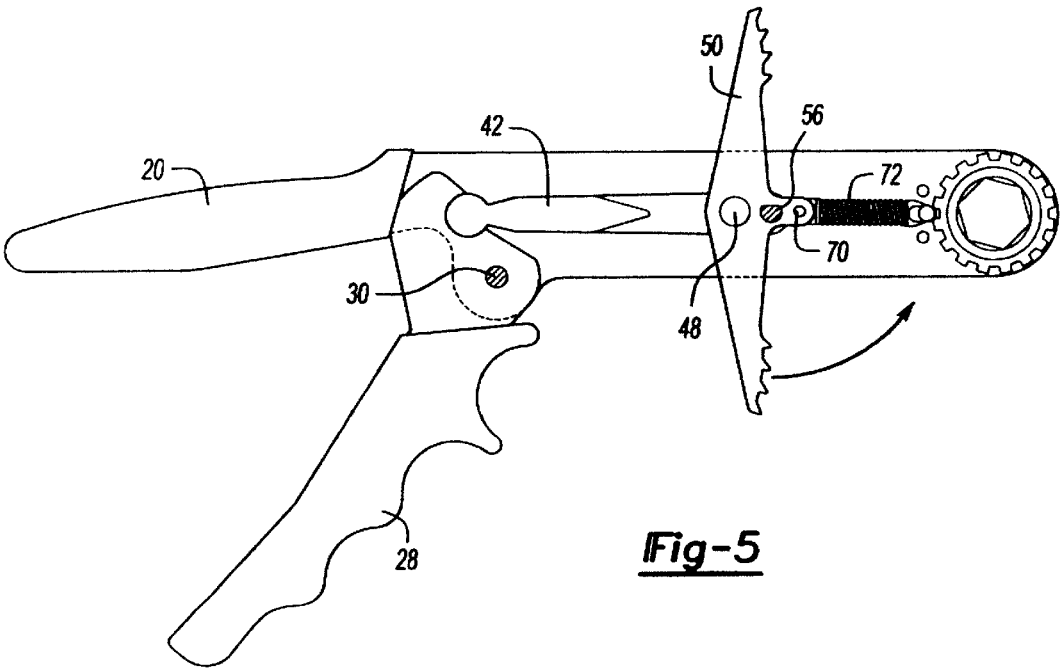
FIG. 5 is a view similar to FIG. 3 showing another position of adjustment of the wrench embodying the invention.

Reversing of the direction of rotation of gear 24 requires turning the handle 60, seen in FIG. 1 and FIG. 2, to swing pawl arm 50 counter-clockwise from the position shown in FIG. 3 to the intermediate position shown in FIG. 5. At that point the support pin 48, guide pin 56 and pivot pin 70 as well as spring 72 and push arm 42 are in alignment with each other in an on-center condition. Continued movement of the handle 60 in a counter clockwise direction swings pawl arm 50 to the position in FIG. 6 and causes an over-center action so that the support pin 48 and pivot pin 70 are in reverse positions from that in FIG. 4 to that in FIG. 6. Subsequent squeezing of the lever 28 results in counter-clockwise rotation of gear 24 as view in FIG. 6.

Although the driving direction of the drive gear 24 of most ratchet wrenches can be reversed by rotating the wrench 10 about its longitudinal axis, the present wrench makes it possible to reverse the drive direction while the wrench remains in position on its work piece.

Figure 6:
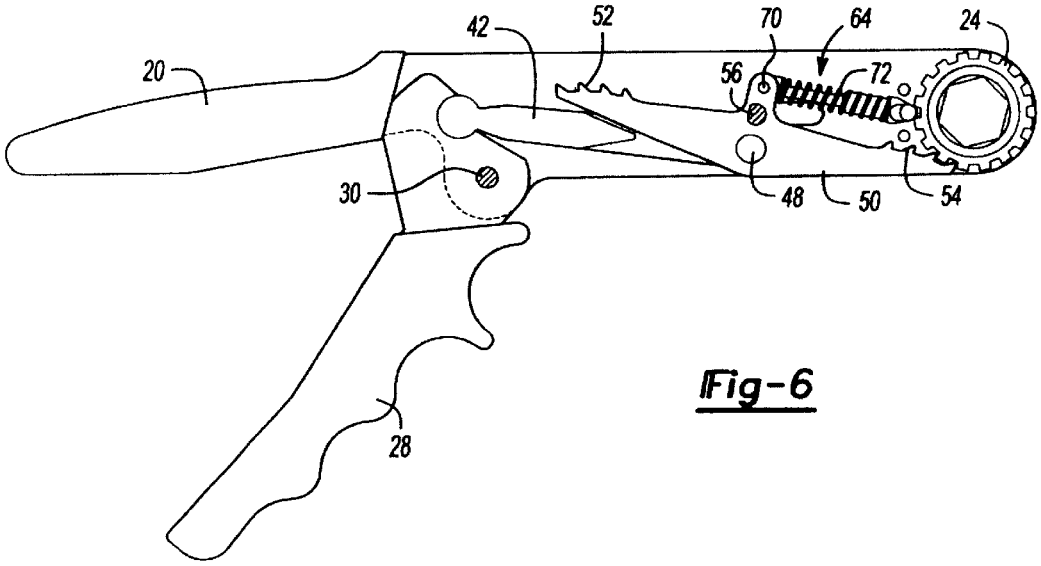
FIG. 6 is a view showing the wrench of the present embodiment of the invention in its reversed position from the position shown in FIG. 4.

The efficient and economical design of the wrench mechanism is emphasized by the use of a single ratchet pawl arm 50 to effect both forward and reverse drive gear action. Also a single spring 72 is used to accomplish three separate functions of the mechanical action of the squeeze wrench 10. For example, spring 72 loads the detent pawl element 66 to engagement with the spur drive gear. Also the spring 72 acts as the force on the squeeze lever 28 to return it to its original position. It also loads the over-center mechanism of the reversing pawl arm 50 as seen in FIG. 5 to act at opposite sides of the guide pin 56 as shown in FIG. 4 and FIG. 6.

A reversible, squeeze type ratchet wrench has been provided in which the drive direction can be changed without removing the tool from the bolt or work piece being worked on. Moreover, the operation is achieved by a mechanism employing a minimum of parts and utilizing a single spring to accomplish multiple functions such as return action the squeeze handle, spring loading of the detent and offering over-center operation of the pawl arm in both of its directions of drive.

I claim:

1. A squeeze type wrench comprising:

an elongated body member having first and second ends;

a handle at said first end of said body member;

a toothed drive gear rotatable at said second end of said body member;

a tool element detachably connected to said drive gear for rotation therewith;

a finger grip lever pivoted to said body member for movement between first and second positions;

a push arm having a first end engagable with said grip lever and a second end moveable longitudinally relative to said body member;

an elongated pawl member having a midpoint pivoted to said second end of said push arm for movement therewith;

a set of gear engaging teeth formed at each end of said pawl member for movement of a selected one of said sets into engagement with teeth at a selected side of said drive gear;

said finger grip lever being moveable relative to said handle to move said push arm and said pawl member as a unit to rotate said drive gear in one direction with one set of said teeth engaged with said drive gear and in the other direction with the other set of said teeth in engagement with said drive gear; and spring means for resiliently resisting pivoting of said finger grip lever toward said handle and assisting pivoting away from said handle.

2. The squeeze type wrench of claim 1 wherein said elongated pawl member is guided for movement longitudinally of said body member.

3. The squeeze type wrench of claim 2 wherein pawl member is provided with a guide pin slideable in longitudinal slots in said body member.

4. The squeeze type wrench of claim 1 and further comprising an arm extending radially from said mid-point of said pawl member, said spring means acting between said arm and said drive gear to urge a selected one of said sets of gear engaging teeth into engagement with said drive gear.

5. The squeeze type wrench of claim 1 wherein a detent element is engagable with said drive gear and wherein said spring means acts between said detent element and said pawl member.

6. The squeeze type wrench of claim 3 wherein said pawl member has an arm extending radially away from said pin and said spring means acts between said arm and said gear to urge a selected one of said sets of teeth into engagement with said gear.

7. The squeeze type wrench of claim 6 wherein a detent element is disposed between said drive gear and said spring means.

8. The squeeze type wrench of claim 7 wherein a telescoping guide member is disposed between said detent element and said arm and a spring is supported on said guide member.

9. The squeeze type wrench of claim 8 where said spring means acts to urge said selected set of pawl teeth into engagement with said drive gear, said grip lever to said first position and said detent into engagement with said drive gear.

10. The squeeze type wrench of claim 3 wherein said second end of said push arm is to one side of said guide pin when said one set of teeth on said pawl arm are in engagement with said drive gear and on the other side of said guide pin when said other set of teeth are in engagement with said drive gear.

11. A ratchet wrench comprising:

an elongated body member having a pair of spaced apart frame plates forming a recess therebetween;

a rotatable spur gear having a plurality of teeth on its circumference mounted at one end of said body member in said recess;

a first handle formed at the other end of said body member;

a second handle mounted at an intermediate portion of said body member for pivotal movement toward and away from said first handle;

a push arm disposed in said recess and having one end in engagement with said second handle for movement thereby and the other end having a drive pin guided for longitudinal movement toward and away from said gear;

an elongated pawl element mounted in said recess and on said drive pin for movement with and for pivotal movement relative to said push arm, said pawl element having a set of teeth at each end of said pawl element with a first one of said sets being engagable with a first circumferential side of said spur gear to rotate the latter in one direction upon movement of said second handle toward said first handle and in the other direction upon engagement of said second one of said sets of teeth with a second circumferential side of said spur gear; and spring means resiliently resisting movement of said handles toward each other.

12. The wrench of claim 11 wherein said pawl arm has a pivot pin at an intermediate portion extending transversely of said body member and guided in slots in said frame plates.

13. The wrench of claim 11 wherein said spring means acts on said pawl element to resiliently resist movement of said push arm and handle in a drive direction and assist movement in a return direction.

14. The wrench of claim 11 wherein said spring means acts on a portion of said pawl element spaced from said pivot pin to urge a selected set of said teeth into engagement with said gear teeth.

15. The wrench of claim 14 wherein said portion on said pawl element is disposed to one side of said pivot pin when said first one of said sets of teeth are engaged with said gear and disposed to the other side of said pivot pin when said second one of said sets of teeth are engaged with said gear.

16. The wrench of claim 11 and further comprising a detent means engagable with said gear, said spring means acting on said detent means to maintain said detent in engagement with said teeth.

17. The wrench of claim 11 and further comprising a handle exterior of said body member and fixed to said pin for rotating said pawl element to a selected position placing a selected one of said sets of teeth in engagement with said gear to rotate said gear in a selected direction.

18. The wrench of claim 14 wherein said drive pin, pivot pin and portion are in alignment with each other with said drive pin to one side of said pivot pin when one set of teeth are in engagement with said gear and to the other side of said pivot pin when the other set of teeth are in engagement with said gear.

19. The wrench of claim 16 wherein said detent means includes a telescoping guide member having a detent element at one end and being pivoted to said portion on said pawl arm at the other end, said spring being supported on said guide member.

* * * * *